US009079753B2

(12) United States Patent
Kosjer

(10) Patent No.: US 9,079,753 B2
(45) Date of Patent: Jul. 14, 2015

(54) VEHICLE LIFTING ASSEMBLY

(76) Inventor: Marcus Kosjer, Douglass, KS (US)

( * ) Notice: Subject to any disclaimer, the term of this patent is extended or adjusted under 35 U.S.C. 154(b) by 599 days.

(21) Appl. No.: 13/457,010

(22) Filed: Apr. 26, 2012

(65) Prior Publication Data

US 2013/0056692 A1 Mar. 7, 2013

Related U.S. Application Data

(60) Provisional application No. 61/480,254, filed on Apr. 28, 2011.

(51) Int. Cl.

| | |
|---|---|
| ***B66F 7/10*** | (2006.01) |
| ***B66F 5/04*** | (2006.01) |
| ***B66F 7/28*** | (2006.01) |

(52) U.S. Cl.

CPC .... *B66F 5/04* (2013.01); *B66F 7/28* (2013.01)

(58) Field of Classification Search

CPC ..... B66F 5/00
USPC ..... 294/81.5, 81.54; 414/608; 254/2 R, 89 R, 254/2 B, 10 B, 133 R, 134
See application file for complete search history.

(56) References Cited

U.S. PATENT DOCUMENTS

| | | | | |
|---|---|---|---|---|
| 2,012,430 | A * | 8/1935 | Kuhlman | 254/89 H |
| 2,029,022 | A * | 1/1936 | Graham | 254/1 |
| 2,536,550 | A * | 1/1951 | Hughes | 254/133 R |
| 2,568,827 | A * | 9/1951 | Schallock | 254/133 R |
| 2,748,459 | A * | 6/1956 | Orr | 269/296 |
| 2,905,501 | A * | 9/1959 | Jakubowski | 294/81.3 |
| 3,582,043 | A * | 6/1971 | Tranchero | 254/2 R |
| 5,123,802 | A * | 6/1992 | Bell | 414/563 |
| 5,984,616 | A * | 11/1999 | Youmans et al. | 414/563 |
| 7,278,627 | B2 | 10/2007 | Jones | |
| 7,494,313 | B2 * | 2/2009 | Craze | 414/563 |
| 2006/0278855 | A1 * | 12/2006 | Krug | 254/4 B |
| 2010/0102284 | A1 * | 4/2010 | Drake | 254/1 |
| 2011/0253955 | A1 * | 10/2011 | Gann et al. | 254/10 R |
| 2013/0248784 | A1 * | 9/2013 | Rose | 254/11 |

* cited by examiner

*Primary Examiner* — Lee D Wilson
*Assistant Examiner* — Henry Hong
(74) *Attorney, Agent, or Firm* — Kenneth H. Jack; Davis & Jack, L.L.C.

(57) ABSTRACT

A yoke for receiving, raising, and lowering a vehicle having left and right tires by engagement with the left and right tires, the yoke having a left capture frame; a right capture frame; a span member having left and right ends, and having a medial jack clearance space arch; left and right socket joints for mounting the left and right capture frames upon the span member's left and right ends; and a rotation stopping pin fixedly attached to the arch, the rotation stopping pin being fitted for engaging a socket within a distal end of a trolley jack's lift arm.

7 Claims, 10 Drawing Sheets

VEHICLE LIFTING ASSEMBLY

CLAIM OF PRIORITY FROM PREVIOUSLY FILED PROVISIONAL PATENT APPLICATION

This non-provisional patent application claims the benefit of and priority from U.S. provisional patent application No. 61/480,254 filed Apr. 28, 2011. The inventor disclosed in said provisional application is the same person as the person who is disclosed as the inventor in the instant application. The applicant asserts that structures and functions of structures disclosed and described in the instant application are substantially identical to those disclosed in said provisional application.

FIELD OF THE INVENTION

This invention relates to vehicle lifting equipment, including jacks and vehicle engaging members of jacks. More particularly, this invention relates to such assemblies which are adapted for securely engaging and lifting a vehicle's paired front or rear tires.

BACKGROUND OF THE INVENTION

Commonly known types of vehicle lifting or jacking assemblies include hydraulic bottle jacks, scissor lifts, and rachet actuated "high lift" jacks, each of which operatively engages a single under-carriage point of a vehicle for lifting the vehicle. While such jacking assemblies are desirably compact, they are often undesirably unstable. They typically lift a vehicle in an imbalanced fashion, tilting the vehicle at an odd angle away from the singular lifting point.

Another type of commonly known vehicle lifting or jacking assembly combines a rolling base, a lift column extending upwardly from the base, a tire engaging bracket and a winch lift which draws upwardly toward the lift column's upper end. Such assemblies are advantageously adapted for simultaneously engaging a vehicle's paired front or rear tires, and for simultaneously raising the front or rear of the vehicle. While such jacking assemblies advantageously lift a vehicle in a level, balanced and stable fashion, such assemblies are typically overly bulky, and are mechanically complicated, including numerous parts.

The instant inventive vehicle lifting assembly solves or ameliorates the problems of the vehicle lifting assemblies discussed above, while preserving each of their benefits, through the provision of a wheel engaging yoke, such yoke being attachable in the manner of an auxiliary equipment attachment to a hydraulically actuated trolley jack.

BRIEF SUMMARY OF THE INVENTION

A first structural component of the instant inventive vehicle lifting assembly comprises a laterally extending yoke having a left tire capturing frame and having a right capturing frame. In a preferred embodiment, the medial or central span of the yoke arches upwardly to form and define a trolley jack clearance space.

A further structural component of the instant inventive assembly comprises a trolley jack which may be forwardly rolled to a position at which the lift foot at the distal end of the trolley jack's lift arm enters the space beneath the yoke's preferably upwardly arching medial portion. Thereafter, for example, the front wheels of a lawn or garden tractor may be rolled into the yoke's tire capturing frames. Thereafter, the trolley jack may be actuated to extend its lift arm upwardly for engagement of the foot at a central point under the arching medial span of the yoke.

In a preferred embodiment of the inventive assembly, the lift foot of the trolley jack component presents an upwardly opening pin receiving socket. The yoke component preferably includes a pin which is fixedly attached to and extends downwardly from the arching medial span of the yoke. Engagement of such pin with such upwardly opening trolley jack socket advantageously resists any longitudinal pivoting motion of the yoke while the trolley jack lifts both the yoke and the vehicle's front end.

Accordingly, objects of the instant invention include the provision of a vehicle lifting assembly which incorporates structures as described above and which arranges such structures in relation to each other for performance of the functions as described above.

Other and further objects, benefits, and advantages of the instant invention will become known to those skilled in the art upon review of the Detailed Description which follows, and upon review of the appended drawings.

BRIEF DESCRIPTION OF THE DRAWINGS (Statement regarding form of drawings: The drawings submitted are photographic in nature, and the Applicant states that the structures depicted admit of illustration by drawing within the meaning of 37 C.F.R. §1.84(b)(1). However, the Applicant asserts that the photographic drawings are the same as those submitted with the Application No. 61/480,254 provisional filing, and they are sufficient for examination. Accordingly, the Applicant requests that any Examiner's requirement of replacement drawings be asserted after examination.)

Figure 4:
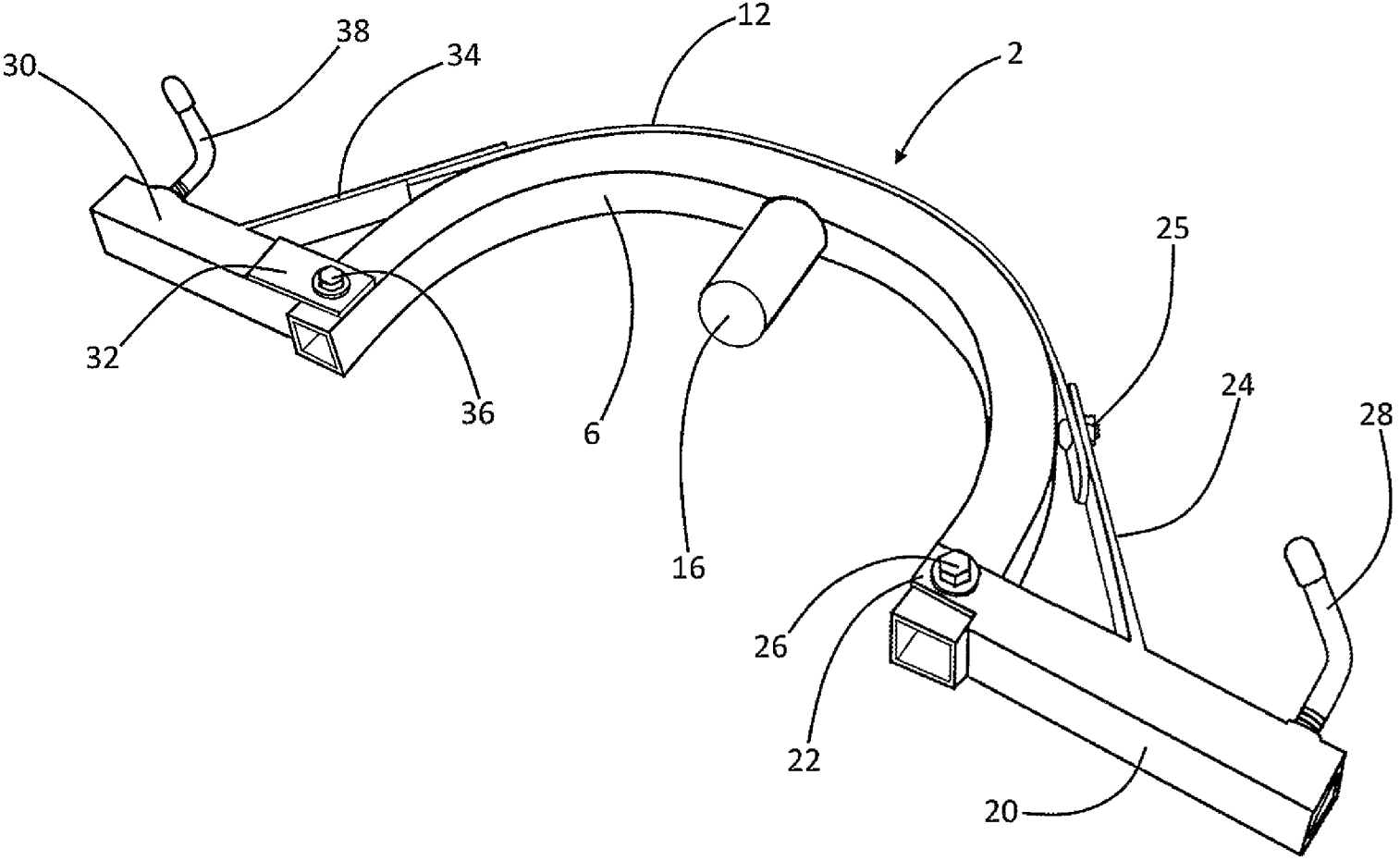
FIG. 4 is a perspective view of a disassembled medial span component of the yoke of FIG. 1.
Figure 6:
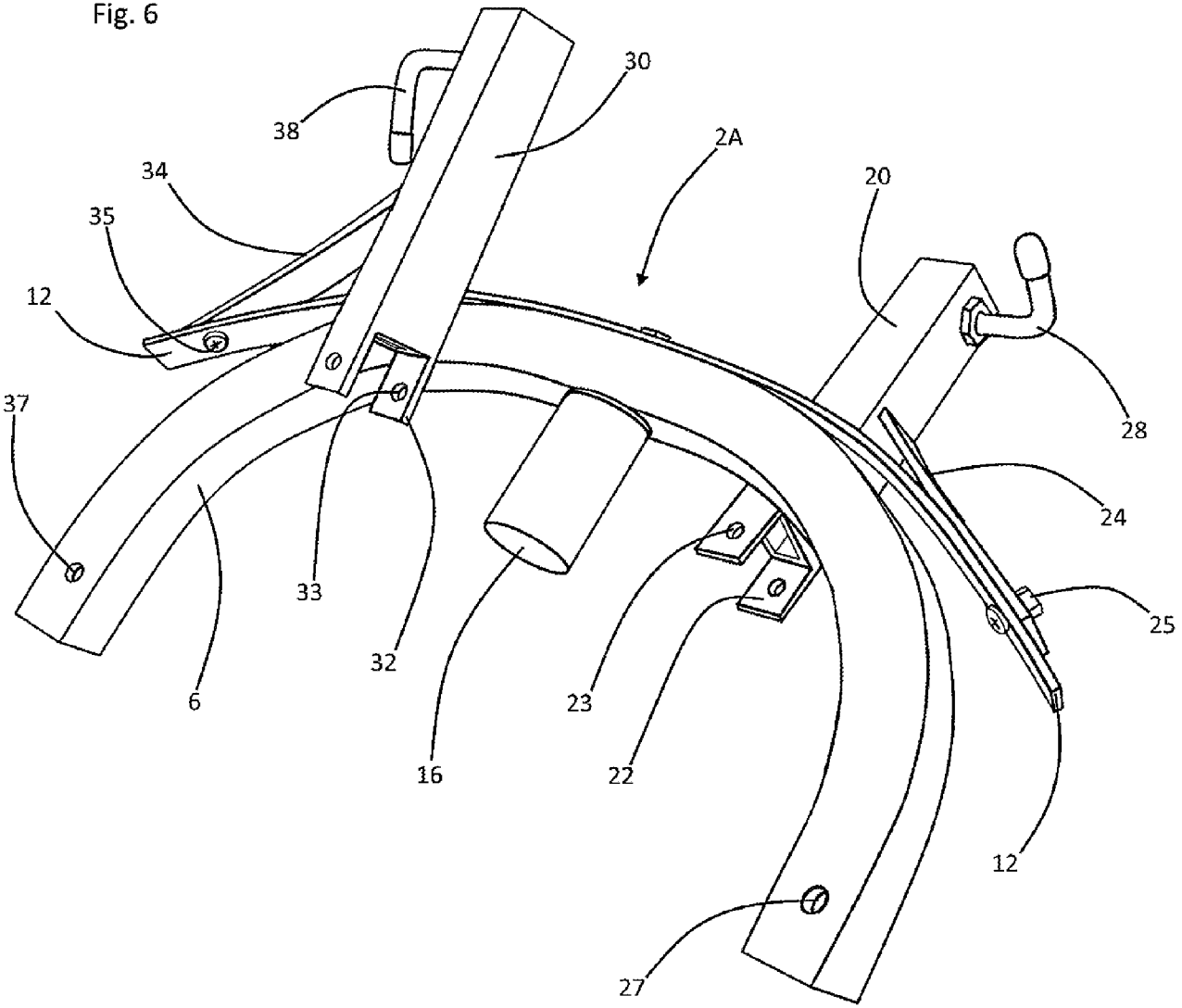

FIG. 6 redepicts the structure of FIG. 4, the view of FIG. 6 showing the medial span arm components pivotally moved to a compact storage configuration.

Figure 7:
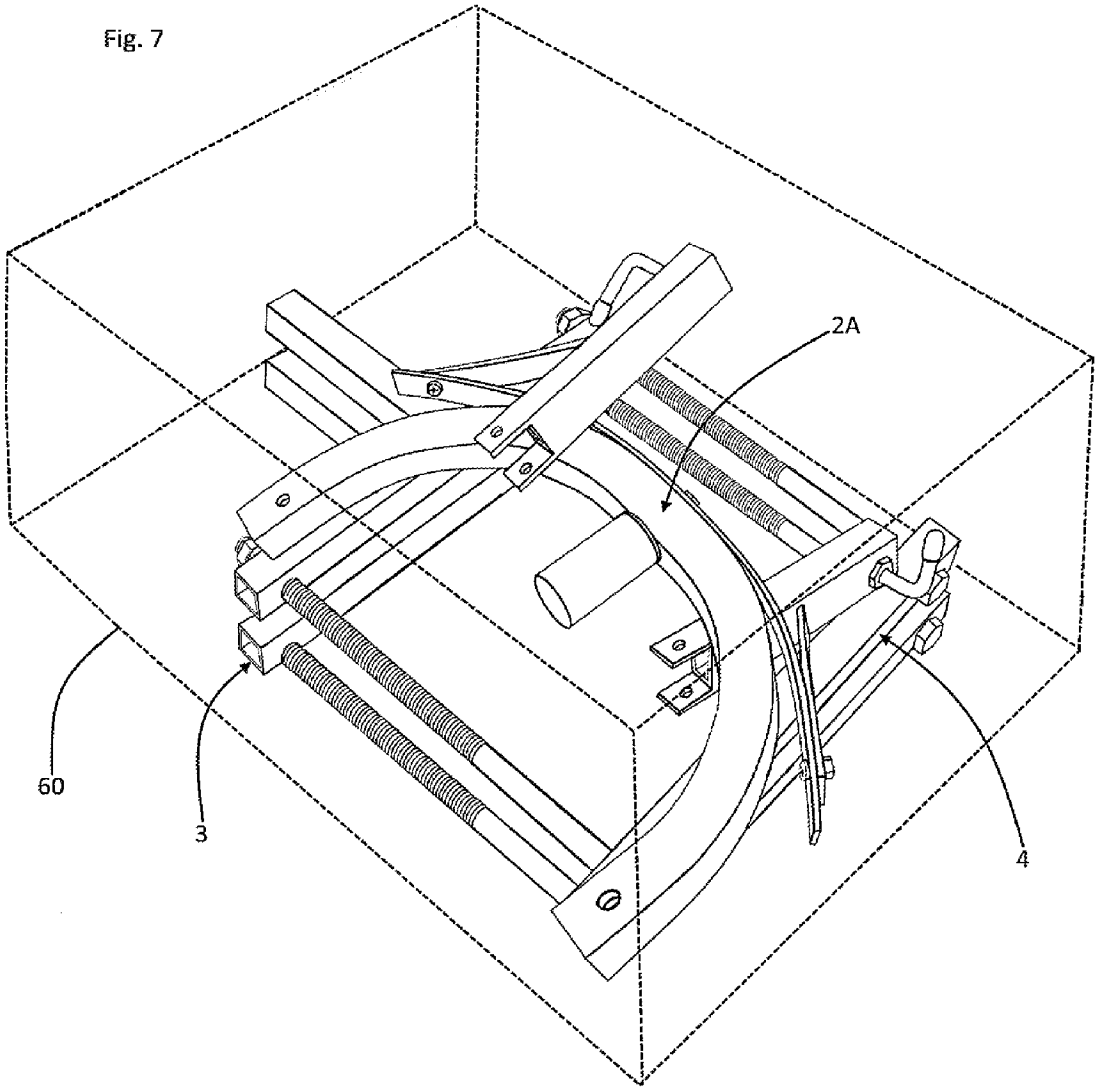

FIG. 7 redepicts FIG. 6, the view of FIG. 7 demonstrating compact storage of disassembled components within a box represented by dashed lines.

Figure 8:
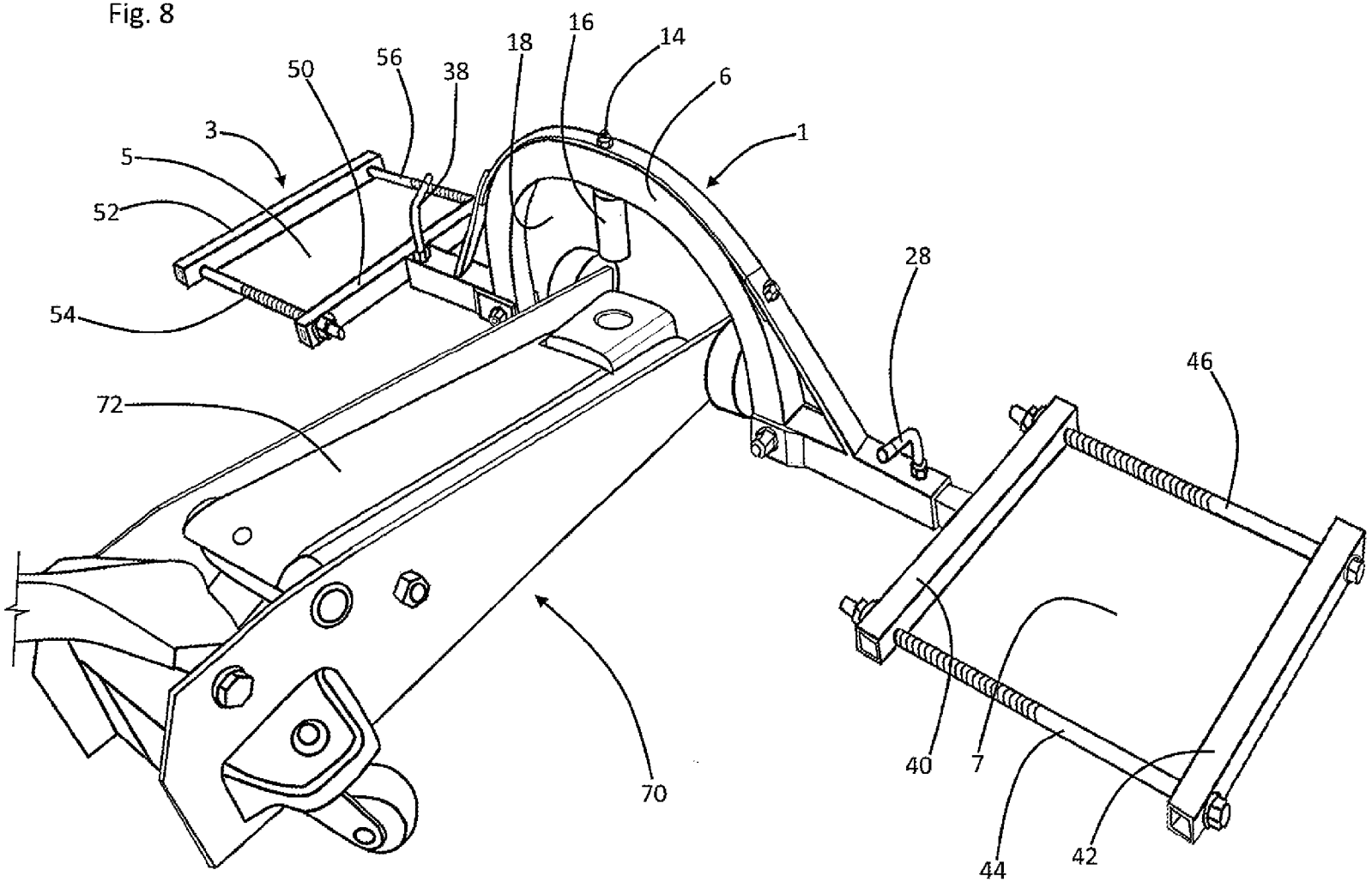

FIG. 8 depicts trolley jack and yoke components of the instant inventive assembly.

Figure 9:
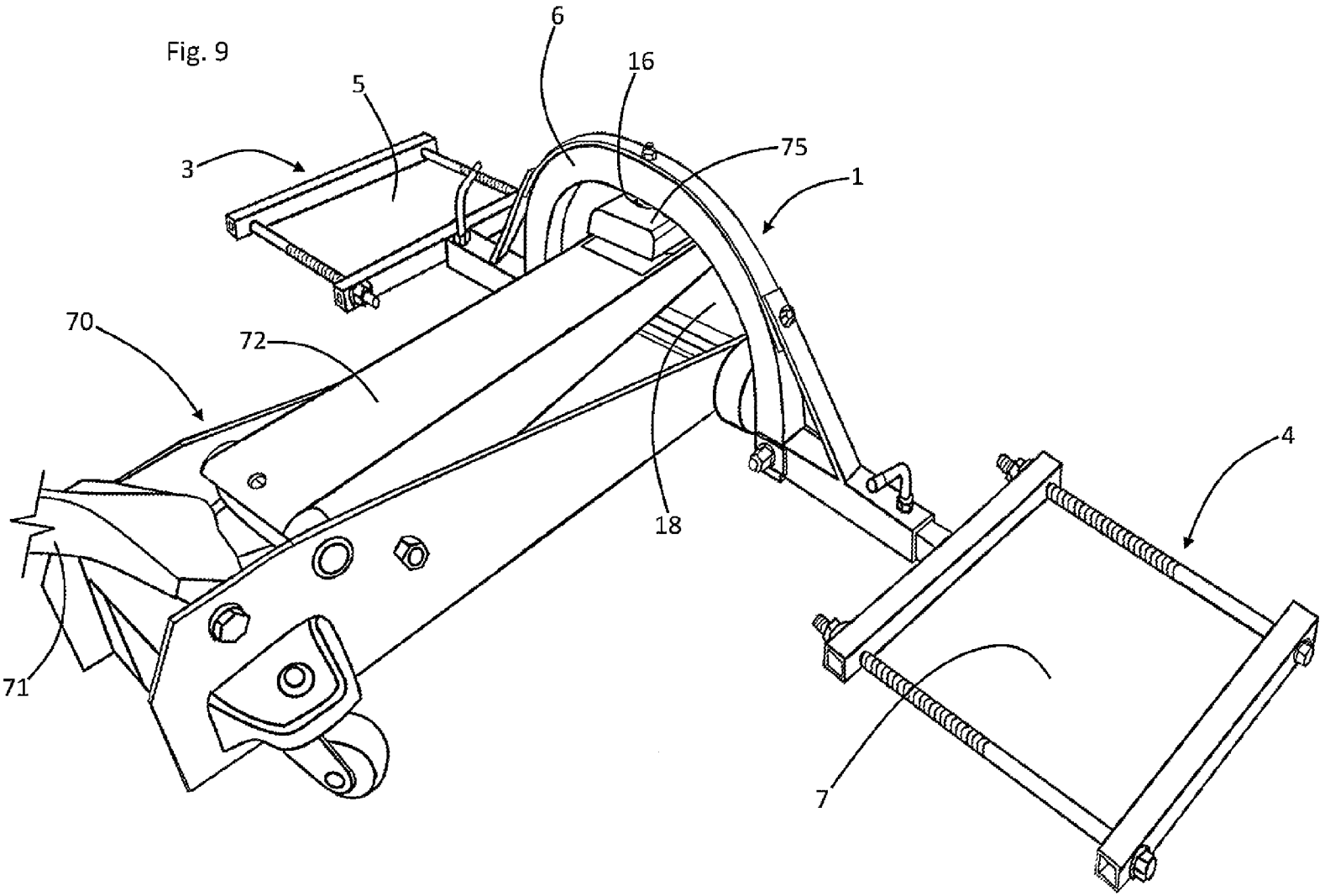

FIG. 9 redepicts FIG. 8, the view of FIG. 9 showing trolley jack lift arm and foot components raised for initial engagement with yoke component.

Figure 10:
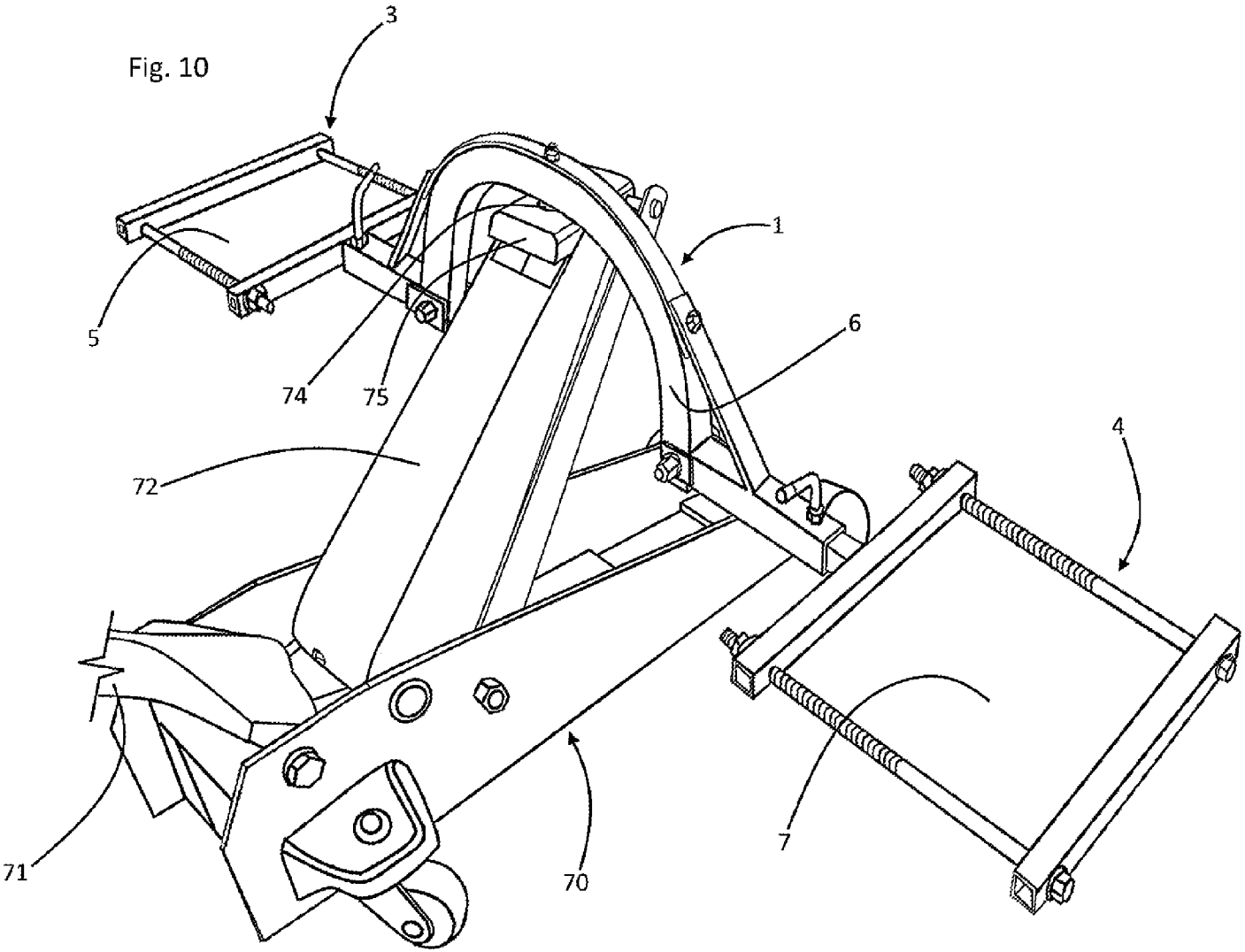

FIG. 10 redepicts FIGS. 8 and 9, the view of FIG. 10 showing the yoke component upwardly lifted by the trolley jack component.

DETAILED DESCRIPTION OF A PREFERRED EMBODIMENT

Figure 1:
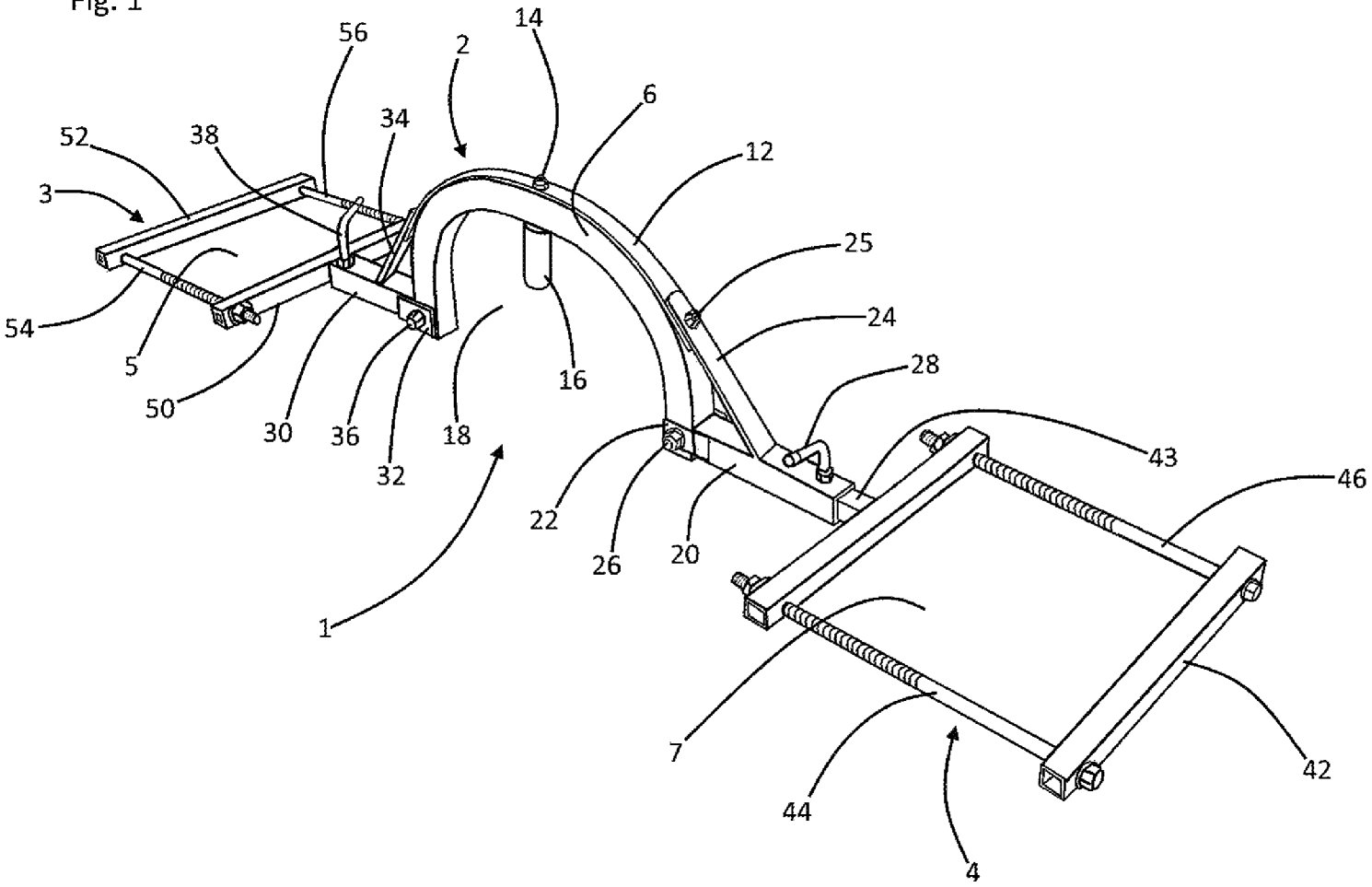
FIG. 1 is a perspective view of a yoke component of the instant inventive vehicle lifting assembly.

Referring now to the drawings, and in particular to Drawing FIG. 1, a preferred embodiment of a yoke component of the instant inventive vehicle lifting assembly is referred to generally by Reference Arrow 1. In a preferred embodiment, the yoke 1 comprises a medial span member which is referred to generally by Reference Arrow 2. The medial span member 2 preferably comprises an upwardly arching member 6. A central bolt receiving eye (not depicted within views) preferably extends centrally and vertically through the medial span member 6, such eye vertically receiving a bolt 14 (the functions of bolt 14 being further described below).

Figure 2:
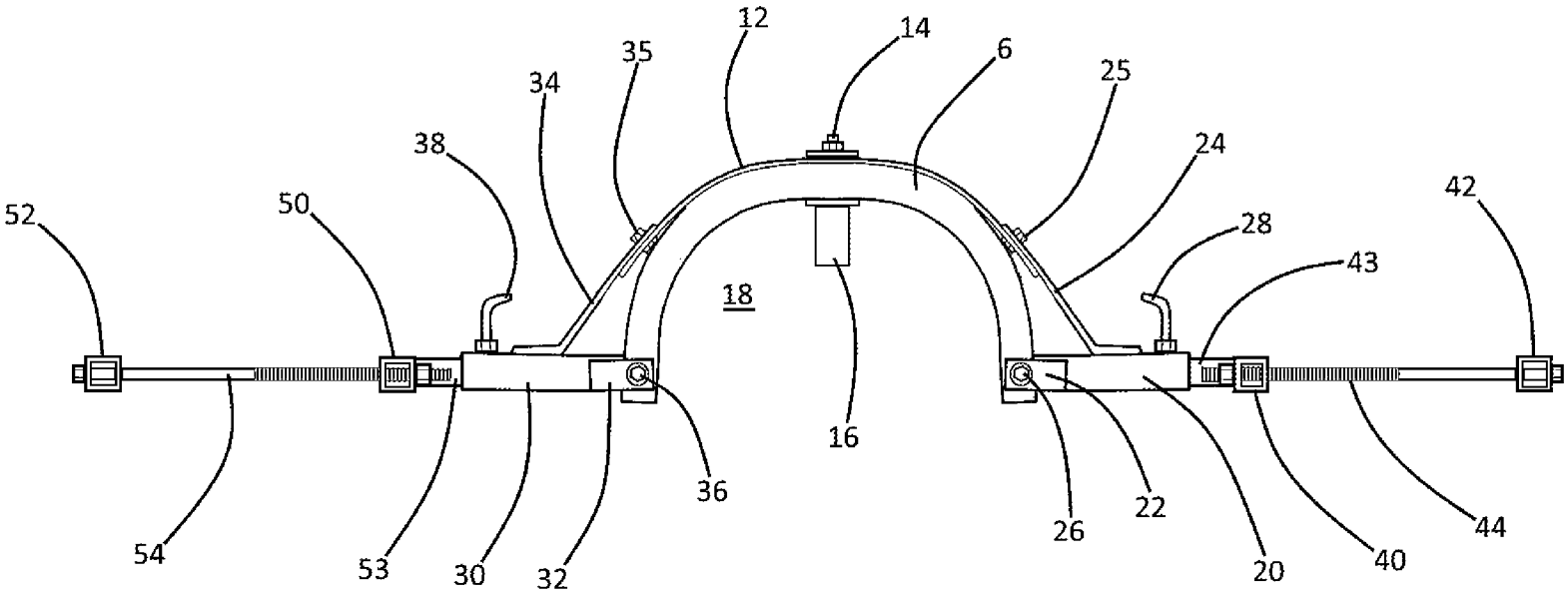
FIG. 2 is a front plan view of the yoke of FIG. 1.

Referring simultaneously to FIGS. 2 and 6, the right and left ends of the arch member 6 preferably present longitudinally extending clevis pin receiving eyes 27 and 37 (the functions of which are further discussed below), and the upward arch of member 6 advantageously forms and defines a trolley jack receiving space 18.

Referring to FIG. 4, further structural components of the medial span member 2 preferably comprise attachable and detachable left and right arms 20 and 30, the right arm 20 having a rightwardly opening frame mounting socket 21, and the left arm 30 similarly having a leftwardly opening frame mounting socket (such socket not being exposed to views). Referring further to FIG. 6, the respective proximal or inner ends of arms 20 and 30 preferably respectively present clevis mounts 22 and 32, such clevis mounts respectively having longitudinally opening clevis pin receiving eyes 23 and 33. Upon receipt of the lower right and left ends of arch member 6 within the "U" shaped valleys of the clevises 22 and 32, the clevis pin receiving eyes 23 and 33 may longitudinally align with eyes 27 and 37 for receipt of clevis pin bolts 26 and 36. Triangulating support ties 24 and 34 are preferably fixedly welded to and extend upwardly and inwardly or respectively leftwardly and rightwardly from arms 20 and 30. Referring simultaneously to FIGS. 2 and 4, the upper ends of the angularly extending support ties 24 and 34 are preferably fixedly and pivotally attached to the lower right and left ends of a support strap 12 by nut and bolt combinations 25 and 35. In the preferred embodiment, the support strap 12 is composed of durable steel and is fixedly attached to the arch member 6 by the bolt 14. Manually turnable set screws 28 and 38 are preferably threadedly mounted upon arms 20 and 30, the functions of such set screws 28 and 38 being further discussed below.

Figure 3:
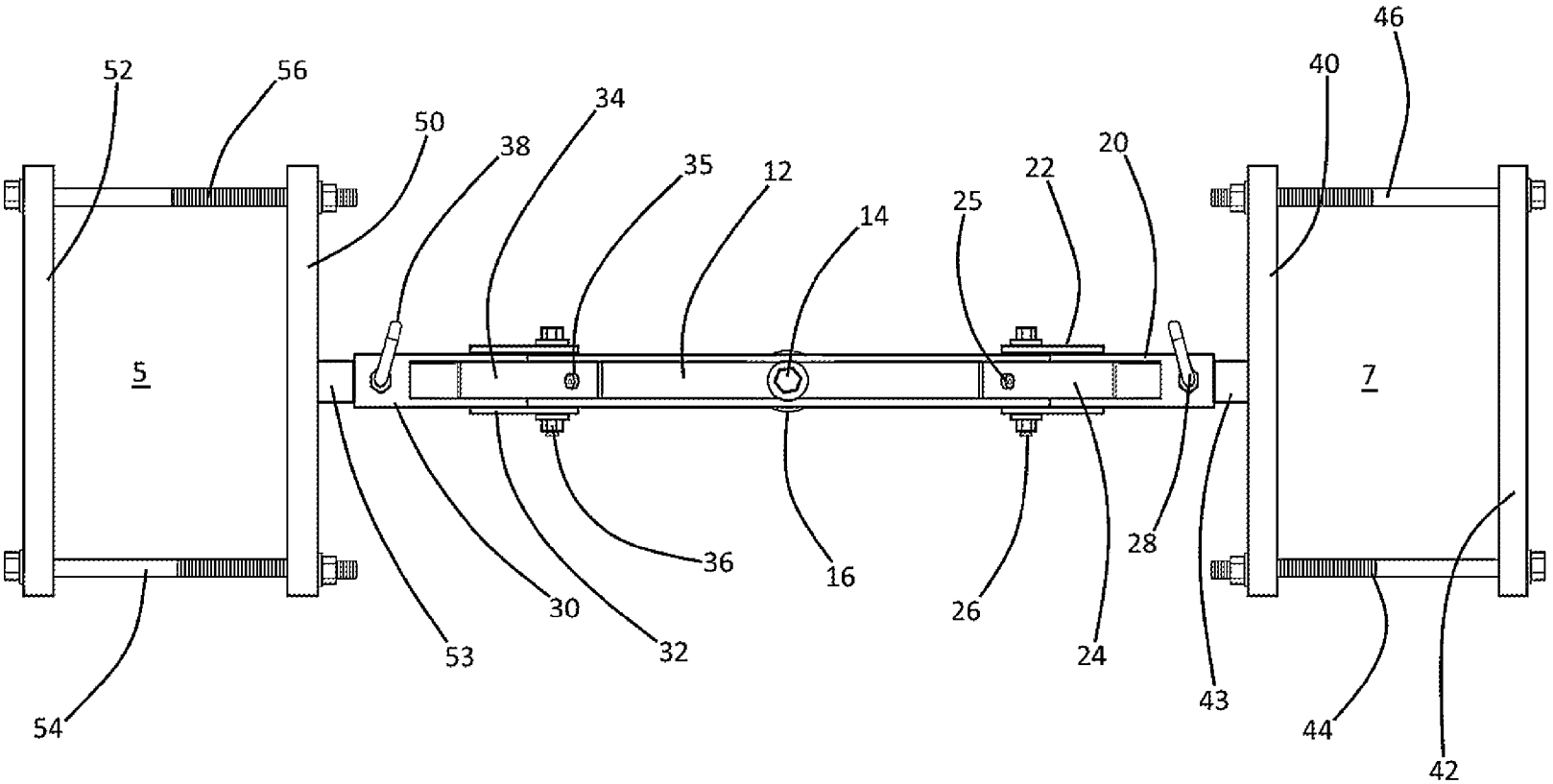
FIG. 3 is an upper plan view of the yoke of FIG. 1.
Figure 5:
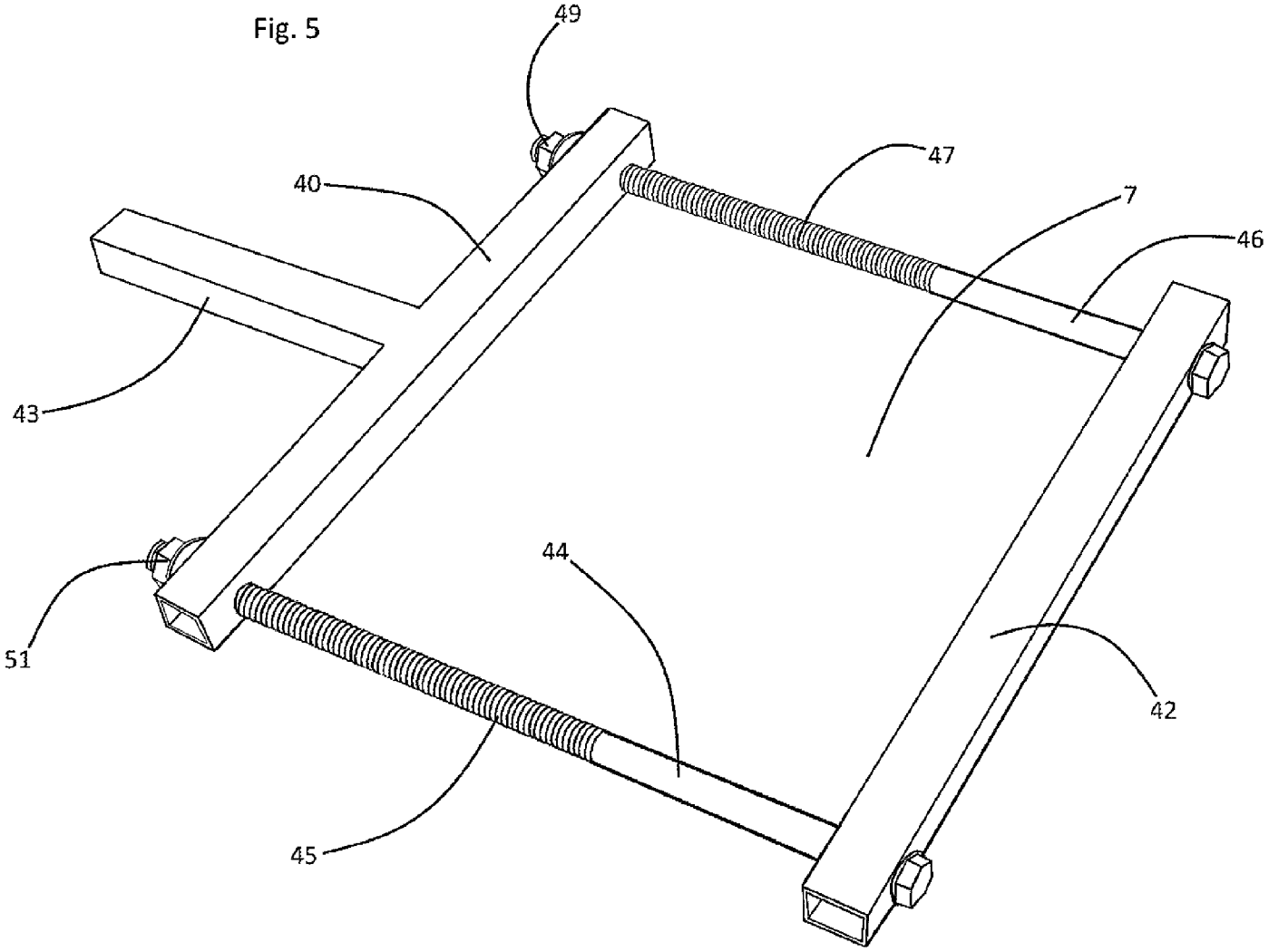
FIG. 5 is a perspective view of a disassembled tire capturing frame component of the yoke of FIG. 1.

Referring simultaneously to FIGS. 1 and 5, the yoke component 1 of the instant inventive vehicle lifting assembly preferably further comprises a right vehicle tire capturing frame 4, such frame 4 preferably comprising a laterally extending mounting post 43, lateral and oppositely lateral frame members 40 and 42, and longitudinal and oppositely longitudinal frame members 44 and 46. The tire capturing frame 4 advantageously forms and defines a square or rectangular vehicle tire receiving and engaging space 7. In a preferred embodiment, the frame 4 includes helical screw threads 45 and 47 upon the longitudinal and oppositely longitudinal frame members 44 and 46, the functions of such threads 45 and 47 being further discussed below. Referring further simultaneously to FIG. 3, the yoke component's left frame member 3 similarly has a mounting post 53, lateral and oppositely lateral frame members 50 and 52, and longitudinal and oppositely longitudinal screw thread adapted frame members 54 and 56, such frame member 3 similarly forming and defining a vehicle tire receiving space 5.

Referring simultaneously to FIGS. 4 and 5, the proximal end of mounting post 43 may be positioned over socket opening 21 of arm 20, and the mounting post 43 may be extended into socket 21 in the manner of a quill and shaft joint. Thereafter, set screw 28 may be turned clockwise to fixedly secure frame member 4 at a desired lateral position. Referring further simultaneously to FIGS. 1 and 2, mounting post 53 of frame member 3 may be similarly rightwardly extended into and engaged with the hollow socket opening of arm 30, and set screw 38 may be similarly tightened there against. Through manipulation of set screws 38 and 28, and through sliding lateral positioning of mounting posts 53 and 43 with respect to arms 30 and 20, frames 3 and 4 may be advantageously locked in laterally displaced position with respect to each other matching the lateral wheel base dimension of a vehicle such as a lawn or garden tractor.

Referring simultaneously to FIGS. 1 and 5, in the event that the front caster wheels of a zero turn radius mower are received within spaces 5 and 7 of frames 3 and 4, nuts 49 and 51 may be turned in order to move frame 42 laterally toward such caster wheel in the manner of a screw actuated clamp until such frame member 42 compresses against a side wall of such caster wheel. Accordingly, the frame member 4 may advantageously receive, engage, and support such caster wheel within space 7 while resisting any undesirable rotation of such caster wheel about its vertical rotation axis. Frame member 3 preferably similarly operates as a caster wheel clamping means.

Referring to FIGS. 1 and 8, the instant inventive vehicle lift assembly preferably further comprises a hydraulic ram actuated trolley jack which is identified by Reference Arrow 70. In use of the assembly, a vehicle such a lawn tractor (not depicted within views) may be rollably moved toward the yoke assembly 1 until the vehicle's left front tire contacts oppositely longitudinally frame member 46, and until the vehicle's right front tire substantially simultaneously contacts oppositely longitudinal frame member 56. Thereafter, the lawn tractor vehicle may be further forwardly rollably moved until the vehicle's left and right front tires respectively roll over frame members 46 and 56, causing such tires to come to rest within central frame spaces 7 and 5. Thereafter, the operator of the instant inventive assembly may roll trolley jack 70 to the position depicted in FIG. 8 wherein the trolley jack's front end enters space 18 to underlie arch member 6, and wherein the trolley jack's foot 75 at the distal end of the trolley jack's lift arm 72 centrally underlies arch 6.

In a preferred embodiment, the trolley jack's foot 75 presents an upwardly opening socket 74. A pin 16 is preferably fixedly and centrally attached to the undersurface of arch 6 by bolt 14. Upon the operator's imposition of a jacking motion to handle 71, the hydraulic cylinder within the housing of jack 70 (cylinder not within views) becomes actuated to raise lift arm 72, causing foot 75 to move upwardly and causing pin 16 to be received within socket 74, as depicted in FIG. 9. Thereafter, referring further simultaneously to FIG. 10, further jacking motion may be applied to handle 71, causing lift arm 72 to raise from the position depicted in FIG. 9 to the position depicted in FIG. 10, such motion raising the yoke assembly 1 along with the front end of the lawn tractor. While the lawn tractor is held at the FIG. 10 position, the downward extensions of the left and right ends of the arch 6, in combination with the engagement of pin 16 with socket 74, resists any undesirable longitudinal pivoting movement of the yoke 1.

Following use of the inventive assembly, the lawn tractor may be lowered, and the trolley jack 70 may be removed. Thereafter, the lawn tractor may be backed out of spaces 5 and 7. Thereafter, set screws 28 and 38 may be turned counterclockwise and frames 3 and 4 may be laterally removed from arms 30 and 20. Thereafter, clevis pin bolts 36 and 26 may be removed, and the lower ends of arch member 6 may be withdrawn from clevises 32 and 22. Thereafter, referring in particular to FIG. 6, arms 30 and 20 may be pivotally moved about pivot bolts 35 and 25 to the compact storage position identified by Reference Arrow 2A. Thereafter, referring further simultaneously to FIG. 7, the yoke components may be stacked within a box 60 (represented by dotted lines), with frame member 4 resting on top of frame member 3, and with the medial portion 2A of the yoke resting on top of frame member 4. The box 60 may be advantageously utilized both for compact shipping, sales packaging, and for user storage.

While the principles of the invention have been made clear in the above illustrative embodiment, those skilled in the art may make modifications in the structure, arrangement, portions and components of the invention without departing from those principles. Accordingly, it is intended that the description and drawings be interpreted as illustrative and not in the limiting sense, and that the invention be given a scope commensurate with the appended claims.

I claim:

1. A yoke for receiving, raising, and lowering a vehicle, the vehicle having left and right tires, the vehicle's receipt, raising and lowering being by engagements with the left and right tires, the yoke comprising:

(a) a left capture frame;

(b) a right capture frame;

(c) a span member having left and right ends, and having a medial jack clearance space arch;

(d) a pivot stopping in connected operatively to the jack clearance space arch;

(e) a left telescoping arm and socket combination, the left telescoping arm and socket combination having a clevis adapted for releasably attaching the left capture frame to the span member's left end; and (f) a right telescoping arm and socket combination, the right telescoping arm and socket combination having a clevis adapted for releasably attaching the right capture frame to the span member's right end, wherein the left and right telescoping arm and socket combinations further comprise set screw and set screw receiving socket combinations connected operatively to the left and right telescoping arm and socket combinations for releasably positioning the said combinations' left and right telescoping arms within said combinations' sockets, and further comprising triangulation support ties, each triangulation support tie having a distal end and a proximal end fixedly attached to one of the sockets among the left and right telescoping arm and socket combinations' sockets.

2. The yoke of claim 1 wherein the pivot stopping pin is fixedly attached to and extends downwardly from the medial jack clearance space arch.

3. The yoke of claim 1 wherein the left and right capture frames define left and right tire receiving spaces, each tire receiving space being substantially rectangular and having a lateral tire width dimension.

4. The yoke of claim 3 further comprising capture frame extending and retracting jack screws connected operatively to the left and right capture frames for alternatively increasing and decreasing the tire receiving spaces' lateral dimensions.

5. The yoke of claim 4 wherein the capture frame extending and retracting jack screws operatively engage clamp bars.

6. The yoke of claim 1 wherein each triangulation support tie is oriented for, upon attachment of its socket's clevis to the one of the ends among the medial jack clearance space arch's left and right ends, extension toward said arch.

7. The yoke of claim 6 further comprising pivot joints, each pivot joint operatively interconnecting the distal end of one of the triangulation support ties with the medial jack clearance space arch.

* * * * *